US010727035B2

(12) United States Patent
Masuko et al.

(10) Patent No.: US 10,727,035 B2
(45) Date of Patent: Jul. 28, 2020

(54) ELECTRON MULTIPLIER

(71) Applicant: HAMAMATSU PHOTONICS K.K., Hamamatsu-shi, Shizuoka (JP)

(72) Inventors: Daichi Masuko, Hamamatsu (JP); Yasumasa Hamana, Hamamatsu (JP); Hajime Nishimura, Hamamatsu (JP); Hiroyuki Watanabe, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/624,027

(22) PCT Filed: Apr. 10, 2018

(86) PCT No.: PCT/JP2018/015081
§ 371 (c)(1),
(2) Date: Dec. 18, 2019

(87) PCT Pub. No.: WO2019/003566
PCT Pub. Date: Jan. 3, 2019

(65) Prior Publication Data

US 2020/0176236 A1 Jun. 4, 2020

(30) Foreign Application Priority Data

Jun. 30, 2017 (JP) ..... 2017-129419

(51) Int. Cl.
*H01J 43/24* (2006.01)

(52) U.S. Cl.
CPC ..... *H01J 43/246* (2013.01)

(58) Field of Classification Search
CPC ..... H01J 43/246
See application file for complete search history.

(56) References Cited

U.S. PATENT DOCUMENTS 6,455,987 B1 * 9/2002 Durst ..... H01J 43/246 250/207
8,237,129 B2 8/2012 Sullivan et al.
(Continued)

FOREIGN PATENT DOCUMENTS

JP 2011-525294 A 9/2011
WO WO-2010/036429 A2 4/2010

OTHER PUBLICATIONS

Internationl Preliminary Report on Patentability dated Jan. 9, 2020 for PCT/JP2018/015081.

*Primary Examiner* — Kevin Quarterman
(74) *Attorney, Agent, or Firm* — Faegre Drinker Biddle & Reath LLP

(57) ABSTRACT

The present embodiment relates to an electron multiplier having a structure configured to suppress and stabilize a variation of a resistance value in a wider temperature range. In the electron multiplier, a resistance layer sandwiched between a substrate and a secondary electron emitting layer comprised of an insulating material is configured using a single metal layer in which a plurality of metal particles comprised of a metal material whose resistance value has a positive temperature characteristic are two-dimensionally arranged on a layer formation surface, which is coincident with or substantially parallel to a channel formation surface of the substrate, in the state of being adjacent to each other with a part of the first insulating material interposed therebetween.

9 Claims, 10 Drawing Sheets

(56) References Cited

U.S. PATENT DOCUMENTS

| | | | | |
|---|---|---|---|---|
| 9,105,379 | B2 | 8/2015 | Elam et al. | |
| 2010/0044577 | A1* | 2/2010 | Sullivan | H01J 43/246<br>250/390.01 |
| 2011/0095174 | A1* | 4/2011 | Suyama | H01J 43/246<br>250/281 |
| 2014/0361683 | A1* | 12/2014 | DeFazio | H01J 3/04<br>315/12.1 |

* cited by examiner

ELECTRON MULTIPLIER

TECHNICAL FIELD

The present invention relates to an electron multiplier that emits secondary electrons in response to incidence of the charged particles.

BACKGROUND ART

As electron multipliers having an electron multiplication function, electronic devices, such as an electron multiplier having channel and a micro-channel plate, (hereinafter referred to as "MCP") have been known. These are used in an electron multiplier tube, a mass spectrometer, an image intensifier, a photo-multiplier tube (hereinafter referred to as "PMT"), and the like. Lead glass has been used as a base material of the above electron multiplier. Recently, however, there has been a demand for an electron multiplier that does not use lead glass, and there is an increasing need to accurately form a film such as a secondary electron emitting surface on a channel provided on a lead-free substrate.

As techniques that enable such precise film formation control, for example, an atomic layer deposition method (hereinafter referred to as "ALD") is known, and an MCP (hereinafter, referred to as "ALD-MCP") manufactured using such a film formation technique is disclosed in the following Patent Document 1, for example. In the MCP of Patent Document 1, a resistance layer having a stacked structure in which a plurality of CZO (zinc-doped copper oxide nanoalloy) conductive layers are formed with an $Al_2O_3$ insulating layer interposed therebetween by an ALD method is employed as a resistance layer capable of adjusting a resistance value formed immediately below a secondary electron emitting surface. In addition, Patent Document 2 discloses a technique for generating a resistance film having a stacked structure in which insulating layers and a plurality of conductive layers comprised of W (tungsten) and Mo (molybdenum) are alternately arranged in order to generate a film whose resistance value can be adjusted by an ALD method.

CITATION LIST

Patent Literature

Patent Document 1: U.S. Pat. No. 8,237,129
Patent Document 2: U.S. Pat. No. 9,105,379

SUMMARY OF INVENTION

Technical Problem

The inventors have studied the conventional ALD-MCP in which a secondary electron emitting layer or the like is formed by the ALD method, and as a result, have found the following problems. That is, it has been found out, through the study of the inventors, that the ALD-MCP using the resistance film formed by the ALD method does not have an excellent temperature characteristic of a resistance value as compared to the conventional MCP using the Pb (lead) glass although stated in neither of the above Patent Documents 1 and 2. In particular, there is a demand for development of an ALD-MCP that enables a wide range of a use environment temperature of a PMT incorporating an image intensifier and an MCP from a low temperature to a high temperature and reduces the influence of an operating environment temperature.

Incidentally, one of factors affected by the operating environment temperature of the MCP is the above-described temperature characteristic (resistance value variation in the MCP). Such a temperature characteristic is an index indicating how much a current (strip current) flowing in the MCP varies depending on an outside air temperature at the time of using the MCP. As the temperature characteristic of the resistance value becomes more excellent, the variation of the strip current flowing through the MCP becomes smaller when the operating environment temperature is changed, and the use environment temperature of the MCP becomes wider.

The present invention has been made to solve the above-described problems, and an object thereof is to provide an electron multiplier having a structure to suppress and stabilize a resistance value variation in a wider temperature range.

Solution to Problem

In order to solve the above-described problems, an electron multiplier according to the present embodiment is applicable to an electronic device, such as a micro-channel plate (MCP), and a channeltron, where a secondary electron emitting layer and the like constituting an electron multiplication channel is formed using an ALD method, and includes at least a substrate, a secondary electron emitting layer, and a resistance layer. The substrate has a channel formation surface. The secondary electron emitting layer is comprised of a first insulating material, and has a bottom surface facing the channel formation surface, and a secondary electron emitting surface which opposes the bottom surface and emits secondary electrons in response to incidence of the charged particles. The resistance layer is sandwiched between the substrate and the secondary electron emitting layer. In particular, the resistance layer includes a metal layer in which a plurality of metal particles comprised of a metal material whose resistance value has a positive temperature characteristic are two-dimensionally arranged on a layer formation surface, which is coincident with or substantially parallel to the channel formation surface, in the state of being adjacent to each other with a part of a first insulating material interposed therebetween. In addition, the number of metal layers existing between the channel formation surface and the secondary electron emitting surface is limited to one.

Incidentally, each embodiment according to the present invention can be more sufficiently understood from the following detailed description and the accompanying drawings. These examples are given solely for the purpose of illustration and should not be considered as limiting the invention.

In addition, a further applicable scope of the present invention will become apparent from the following detailed description. Meanwhile, the detailed description and specific examples illustrate preferred embodiments of the present invention, but are given solely for the purpose of illustration, and it is apparent that various modifications and improvements within the scope of the present invention are obvious to those skilled in the art from this detailed description.

Advantageous Effects of Invention

According to the present embodiment, it is possible to effectively improve the temperature characteristic of the resistance value in the electron multiplier by constituting the resistance layer formed immediately below the secondary electron emitting layer only by the metal layer in which the plurality of metal particles comprised of the metal material whose resistance value has the positive temperature characteristic are two-dimensionally arranged on a predetermined surface in the state of being adjacent to each other with a part of the insulating material interposed therebetween.

DESCRIPTION OF EMBODIMENTS

Figure 1A:
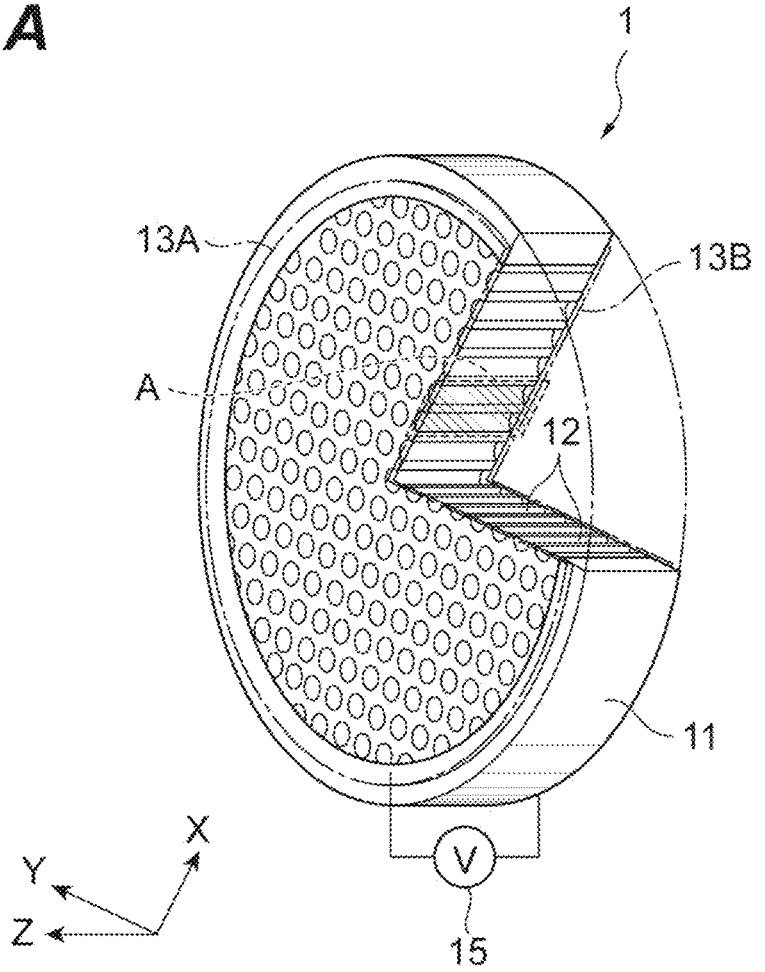
FIGS. 1A and 1B are views illustrating structures of various electronic devices to which an electron multiplier according to the present embodiment can be applied.

Description of Embodiment of Invention of Present Application

First, contents of an embodiment of the invention of the present application will be individually listed and described.

(1) As one aspect of an electron multiplier according to the present embodiment is applicable to an electronic device, such as a micro-channel plate (MCP), and a channeltron, where a secondary electron emitting layer and the like constituting an electron multiplication channel is formed using an ALD method, and includes at least a substrate, a secondary electron emitting layer, and a resistance layer. The substrate has a channel formation surface. The secondary electron emitting layer is comprised of a first insulating material, and has a bottom surface facing the channel formation surface and a secondary electron emitting surface which opposes the bottom surface and emits secondary electrons in response to incidence of the charged particles. The resistance layer is sandwiched between the substrate and the secondary electron emitting layer. In particular, the resistance layer includes a metal layer in which a plurality of metal particles comprised of a metal material whose resistance value has a positive temperature characteristic are two-dimensionally arranged on a layer formation surface, which is coincident with or substantially parallel to the channel formation surface, in the state of being adjacent to each other with a part of a first insulating material interposed therebetween. In addition, the number of metal layers existing between the channel formation surface and the secondary electron emitting surface is limited to one.

Incidentally, the "metal particle" in the present specification means a metal piece arranged in the state of being completely surrounded by an insulating material and exhibiting clear crystallinity when the layer formation surface is viewed from the secondary electron emitting layer side. In this configuration, the resistance layer preferably has a temperature characteristic within a range in which a resistance value of the resistance layer at a temperature of −60° C. is 2.7 times or less, and a resistance value of the resistance layer at +60° C. is 0.3 times or more, relative to a resistance value of the resistance layer at a temperature of 20° C. In addition, as an index indicating the crystallinity of the metal particle, for example, in the case of a Pt particle, a peak at which a full width at half maximum has an angle of 5° or less appears at least on the (111) plane and the (200) plane in a spectrum obtained by XRD analysis.

(2) As one aspect of the present embodiment, the electron multiplier may further include an underlying layer that is provided between the substrate and the secondary electron emitting layer and is comprised of a second insulating material. In this case, the underlying layer has the layer formation surface at a position facing the bottom surface of the secondary electron emitting layer.

(3) As one aspect of the present embodiment, the first insulating material and the second insulating material may be different from each other. Conversely, as one aspect of the present embodiment, the second insulating material may be the same insulating material as the first insulating material. In addition, as one aspect of the present embodiment, the secondary electron emitting layer may be set to be thicker than the underlying layer regarding a thickness of each layer defined along a stacking direction from the channel formation surface to the secondary electron emitting surface. Conversely, as one aspect of the present embodiment, the secondary electron emitting layer may be set to be thinner than the underlying layer regarding the thickness of each layer defined along the stacking direction from the channel formation surface to the secondary electron emitting surface.

(4) As one aspect of the present embodiment, at least one set of metal particles adjacent to each other with a part of the first insulating material interposed therebetween among the plurality of metal particles constituting the metal layer preferably satisfies a relationship in which a minimum distance between the one set of metal particles is shorter than an average thickness of metal particles defined along the stacking direction from the channel formation surface toward the secondary electron emitting surface. Incidentally, the "average thickness" of the metal particles in the present specification means a thickness of a film when a plurality of metal particles two-dimensionally arranged on the layer formation surface are formed into a flat film shape, and the "average thickness" defines a thickness of the metal layer including the plurality of metal particles.

As described above, each aspect listed in [Description of Embodiment of Invention of Present Application] can be applied to each of the remaining aspects or to all the combinations of these remaining aspects.

Details of Embodiment of Invention of Present Application

Specific examples of the electron multiplier according to the present invention will be described hereinafter in detail with reference to the accompanying drawings. Incidentally, the present invention is not limited to these various examples, but is illustrated by the claims, and equivalence of and any modification within the scope of the claims are intended to be included therein. In addition, the same elements in the description of the drawings will be denoted by the same reference signs, and redundant descriptions will be omitted.

Figure 1B:
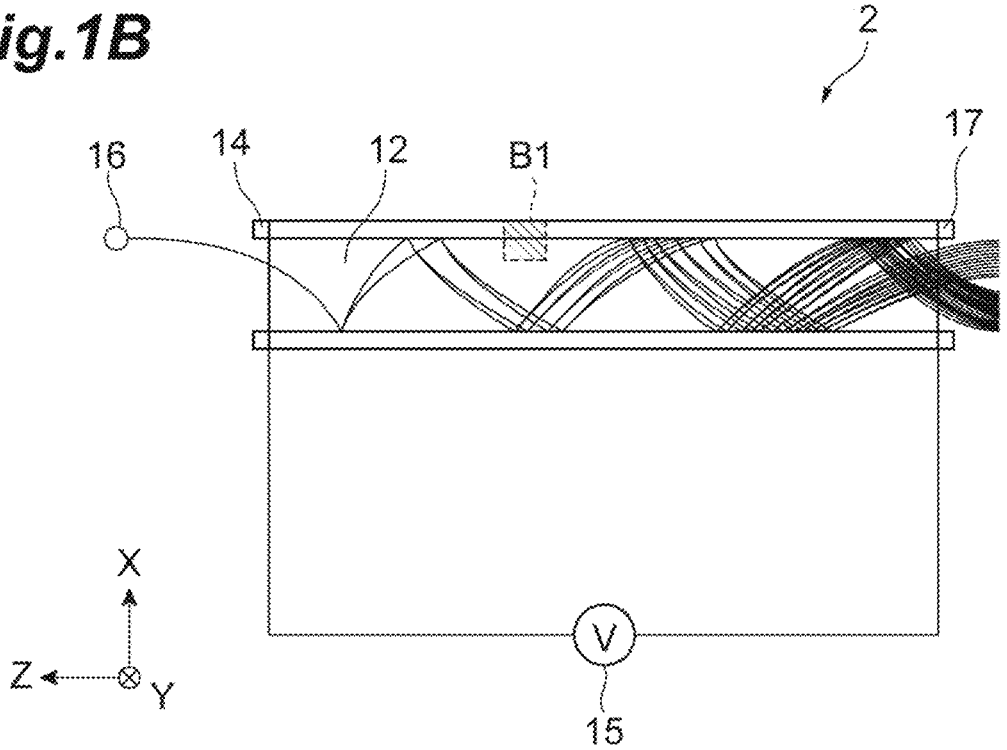

FIGS. 1A and 1B are views illustrating structures of various electronic devices to which the electron multiplier according to the present embodiment can be applied. Specifically, FIG. 1A is a partially broken view illustrating a typical structure of an MCP to which the electron multiplier according to the present embodiment can be applied, and FIG. 1B is a cross-sectional view of a channeltron to which the electron multiplier according to the present embodiment can be applied.

An MCP 1 illustrated in FIG. 1A includes: a glass substrate that has a plurality of through-holes functioning as channels 12 for electron multiplication; an insulating ring 11 that protects a side surface of the glass substrate; an input-side electrode 13A that is provided on one end face of the glass substrate; and an output-side electrode 13B that is provided on the other end face of the glass substrate. Incidentally, a predetermined voltage is applied by a voltage source 15 between the input-side electrode 13A and the output-side electrode 13B.

In addition, a channeltron 2 of FIG. 1B includes: a glass tube that has a through-hole functioning as the channel 12 for electron multiplication; an input-side electrode 14 that is provided at an input-side opening portion of the glass tube; and an output-side electrode 17 that is provided at an output-side opening portion of the glass tube. Incidentally, a predetermined voltage is applied by the voltage source 15 between the input-side electrode 14 and the output-side electrode 17 even in the channeltron 2. When a charged particle 16 is incident into the channel 12 from the input-side opening of the channeltron 2 in a state where the predetermined voltage is applied between the input-side electrode 14 and the output-side electrode 17, a secondary electron is repeatedly emitted in response to the incidence of the charged particle 16 in the channel 12 (cascade multiplication of secondary electrons). As a result, the secondary electrons that have been cascade-multiplied in the channel 12 are emitted from an output-side opening of the channeltron 2. This cascade multiplication of secondary electrons is also performed in each of the channels 12 of the MCP illustrated in FIG. 1A.

Figure 2A:
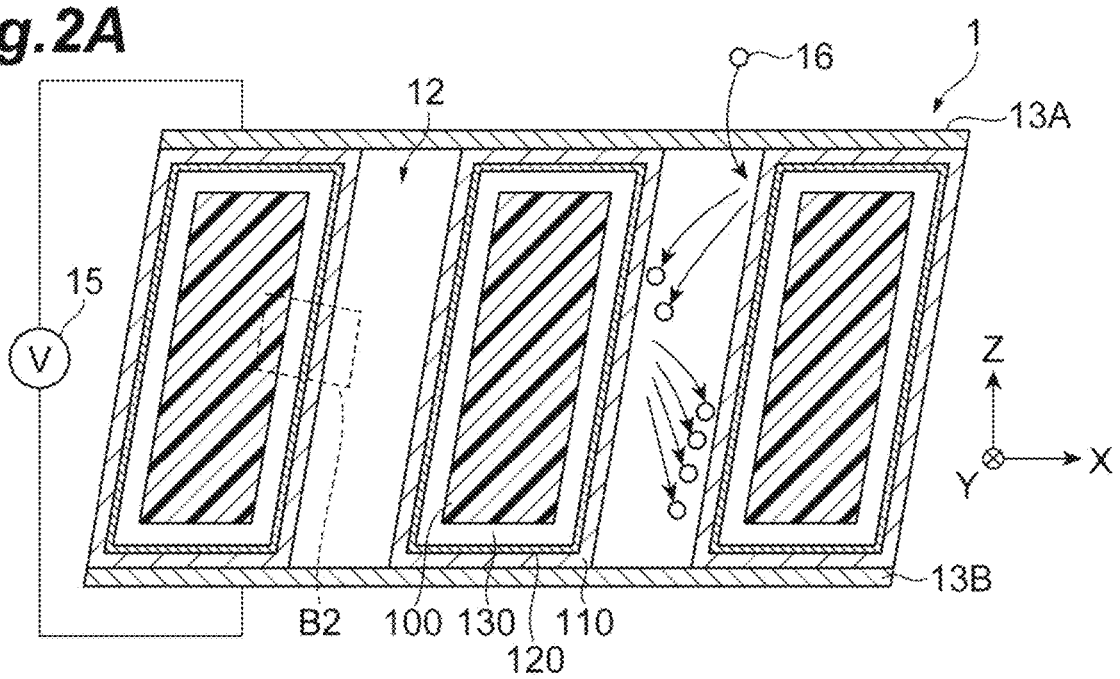
FIGS. 2A to 2C are views illustrating examples of various cross-sectional structures of electron multipliers according to the present embodiment and a comparative example, respectively.
Figure 2B:
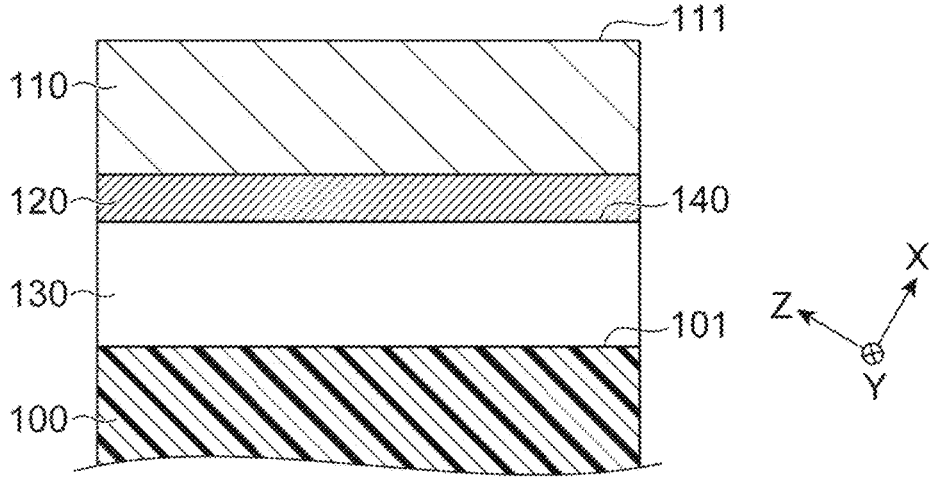
Figure 2C:
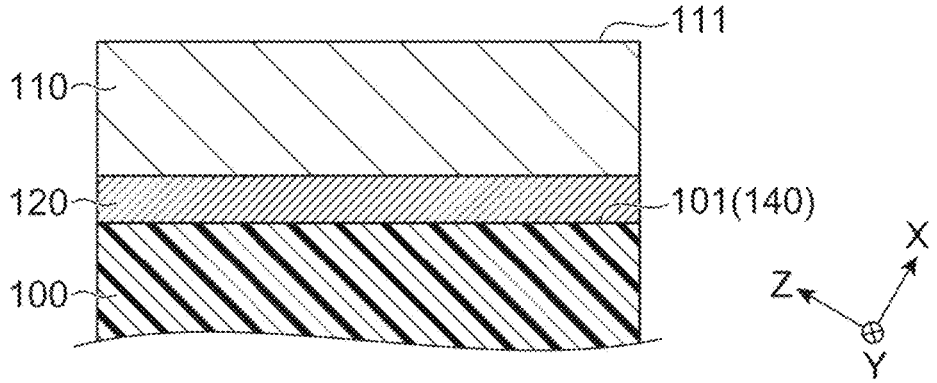

FIG. 2A is an enlarged view of a part (a region A indicated by a broken line) of the MCP 1 illustrated in FIGS. 1A and 1B. FIG. 2B is a view illustrating a cross-sectional structure of a region B2 illustrated in FIG. 2A, and is the view illustrating an example of a cross-sectional structure of the electron multiplier according to the present embodiment. In addition, FIG. 2C is a view illustrating a cross-sectional structure of the region B2 illustrated in FIG. 2A similarly to FIG. 2B, and is the view illustrating another example of the cross-sectional structure of the electron multiplier according to the present embodiment. Incidentally, the cross-sectional structures illustrated in FIGS. 2B and 2C are substantially coincident with the cross-sectional structure in the region B1 of the channeltron 2 illustrated in FIG. 1B (however, coordinate axes illustrated in FIG. 1B are inconsistent with coordinate axes in each of FIGS. 2B and 2C).

As illustrated in FIG. 2B, an example of the electron multiplier according to the present embodiment is constituted by: a substrate 100 comprised of glass or ceramic; an underlying layer 130 provided on a channel formation surface 101 of the substrate 100; a resistance layer 120 provided on a layer formation surface 140 of the underlying layer 130; and a secondary electron emitting layer 110 that has a secondary electron emitting surface 111 and is arranged so as to sandwich the resistance layer 120 together with the underlying layer 130. Here, the secondary electron emitting layer 110 is comprised of a first insulating material such as $Al_2O_3$ and MgO. It is preferable to use MgO having a high secondary electron emission capability in order to improve a gain of the electron multiplier. The underlying layer 130 is comprised of a second insulating material such as $Al_2O_3$ and $SiO_2$. The resistance layer 120 sandwiched between the underlying layer 130 and the secondary electron emitting layer 110 is a single layer, constituted by a plurality of metal particles whose resistance values have positive temperature characteristics and an insulating material (a part of the secondary electron emitting layer 110) filling a portion between the plurality of metal particles, on the layer formation surface 140 of the underlying layer 130. In the present embodiment, the number of resistance layers 120 existing between the channel formation surface 101 of the substrate 100 and the secondary electron emitting surface 111 is limited to one. The plurality of metal particles constituting the resistance layer 120 are preferably comprised of a material whose resistance value has a positive temperature characteristic such as Pt, Ir, Mo, and W. The inventors have confirmed that a slope of the temperature characteristic of the resistance value decreases (see FIG. 9) when the resistance layer 120 is configured using a single Pt layer including a plurality of Pt particles formed into a plane by atomic layer deposition (ALD) as an example as compared to a structure in which a plurality of Pt layers are stacked with an insulating material interposed therebetween. Here, the crystallinity of each metal particle can be confirmed with a spectrum obtained by XRD analysis. For example, when the metal particle is Pt, a spectrum having a peak at which a full width at half maximum has an angle of 5° or less in at least the (111) plane and the (200) plane is obtained in the present embodiment as illustrated in FIG. 10A. In FIGS. 10A and 10B, the (111) plane of Pt is indicated by Pt(111), and the (200) plane of Pt is indicated by Pt(200).

Incidentally, the presence of the underlying layer 130 illustrated in FIG. 2B has no influence on the temperature dependence of the resistance value in the entire electron multiplier. Therefore, the structure of the electron multiplier according to the present embodiment is not limited to the example of FIG. 2B, and may have the cross-sectional structure as illustrated in FIG. 2C. The cross-sectional structure illustrated in FIG. 2C is different from the cross-sectional structure illustrated in FIG. 2B in terms that no underlying layer is provided between the substrate 100 and the secondary electron emitting layer 110. The channel formation surface 101 of the substrate 100 functions as the layer formation surface 140 on which the resistance layer 120 is formed. The other structures in FIG. 2C are the same as those in the cross-sectional structure illustrated in FIG. 2B.

In the following description, a configuration in which Pt is applied as metal particles whose resistance values have positive temperature characteristics and which constitute the resistance layer 120 will be stated.

Figure 3:
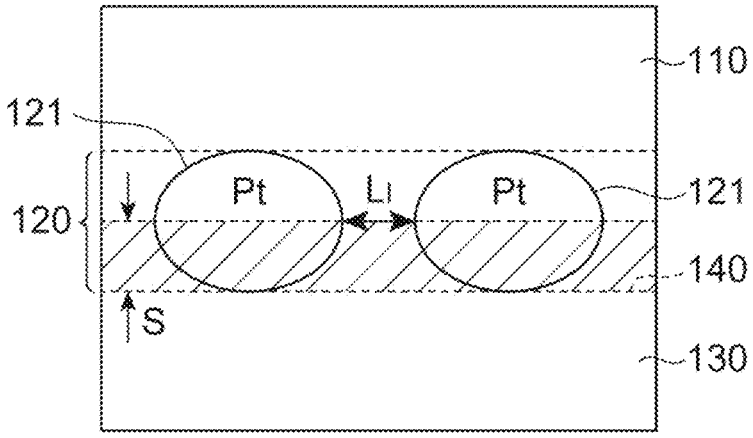
FIG. 3 is an electron conduction model illustrating a structure of the electron multiplier according to the present embodiment, particularly a resistance layer.
Figure 4A:
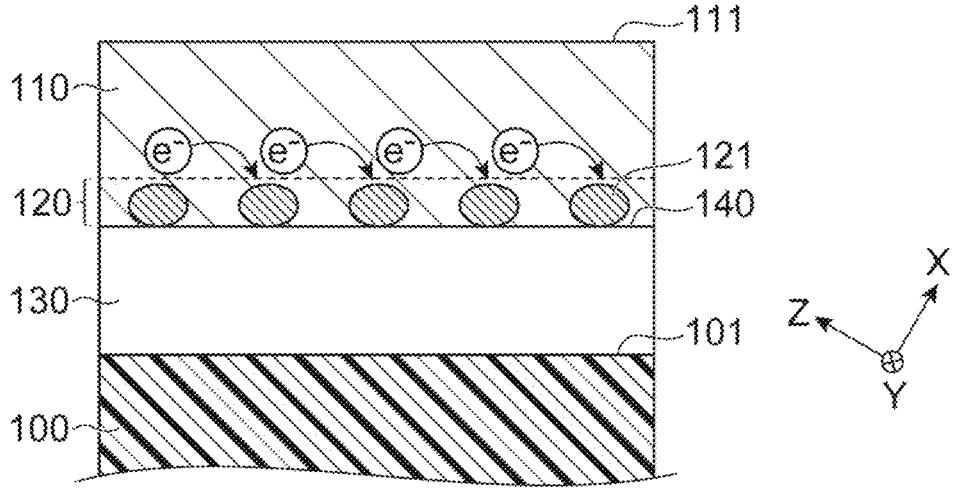
FIGS. 4A and 4B are views for quantitatively describing a relationship between a temperature and an electrical conductivity in the electron multiplier according to the present embodiment, particularly the resistance layer.
Figure 4B:
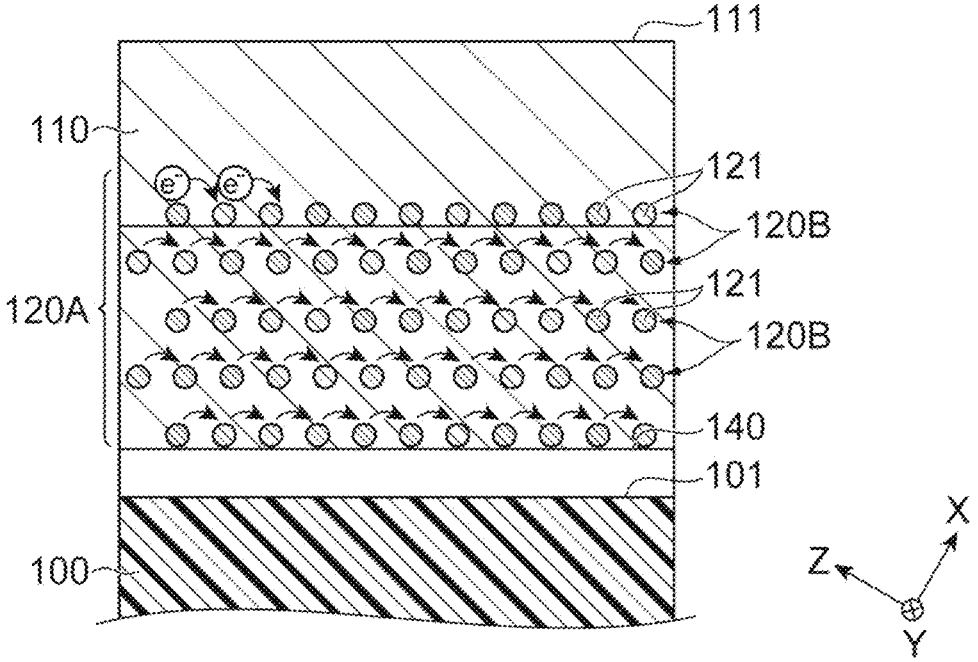

FIGS. 3, 4A, and 4B are views for quantitatively describing a relationship between a temperature and an electrical conductivity in the electron multiplier according to the present embodiment, particularly the resistance layer. In particular, FIG. 3 is a schematic view for describing an electron conduction model in a single Pt layer (the resistance layer 120) formed on the layer formation surface 140 of the underlying layer 130. In addition, FIG. 4A illustrates an example of a cross-sectional model of the electron multiplier according to the present embodiment, and FIG. 4B illustrates an example of a cross-sectional model of an electron multiplier according to a comparative example.

In the electron conduction model illustrated in FIG. 3, Pt particles 121 constituting the single Pt layer (resistance layer 120) are arranged as non-localized regions where free electrons can exist on the layer formation surface 140 of the underlying layer 130 to be spaced by a distance $L_I$ with a localized region where no free electron exists (for example, a part of the secondary electron emitting layer 110 in contact with the layer formation surface 140 of the underlying layer 130) interposed therebetween Incidentally, an average thickness S along a stacking direction of the plurality of Pt particles 121, which constitute the resistance layer 120 and are two-dimensionally arranged on the layer formation surface 140 with a part of the secondary electron emitting layer 110 (first insulating material) interposed therebetween (metal particles whose resistance values have the positive temperature characteristics) satisfies a relationship $S>L_I$ relative to the distance (minimum distance between Pt particles adjacent with the insulating material interposed therebetween) $L_I$ in the present embodiment. Incidentally, the average thickness S of the Pt particle is defined by a thickness of a film when a plurality of Pt particles are formed into a film shape as illustrated in FIG. 3 (the hatched portion in FIG. 3). In addition, the average thickness S corresponds to a thickness of the resistance layer 120.

In addition, a cross-sectional structure of the model defined as the electron multiplier according to the present embodiment is constituted by: the substrate 100; the underlying layer 130 provided on the channel formation surface 101 of the substrate 100; the resistance layer 120 provided on the layer formation surface 140 of the underlying layer 130; and the secondary electron emitting layer 110 that has the secondary electron emitting surface 111 and is arranged so as to sandwich the resistance layer 120 together with the underlying layer 130 as illustrated in FIG. 4A.

On the other hand, a cross-sectional structure of a model defined as the electron multiplier according to the comparative example is constituted by: the substrate 100; the underlying layer 130 provided on the channel formation surface 101 of the substrate 100; a resistance layer 120A provided on the layer formation surface 140 of the underlying layer 130; and the secondary electron emitting layer (insulator) 110 that has the secondary electron emitting surface 111 and is arranged so as to sandwich the resistance layer 120A together with the underlying layer 130 as illustrated in FIG. 4B. A structural difference between the model of the present embodiment (FIG. 4A) and the model of the comparative example (FIG. 4B) is that the resistance layer 120A of the model of the comparative example has a structure in which a plurality of Pt layers 120B are stacked from the channel formation surface 101 toward the secondary electron emitting surface 111 with an insulator layer interposed therebetween while the resistance layer 120 of the model of the present embodiment is configured using the single Pt layer.

Figure 5:
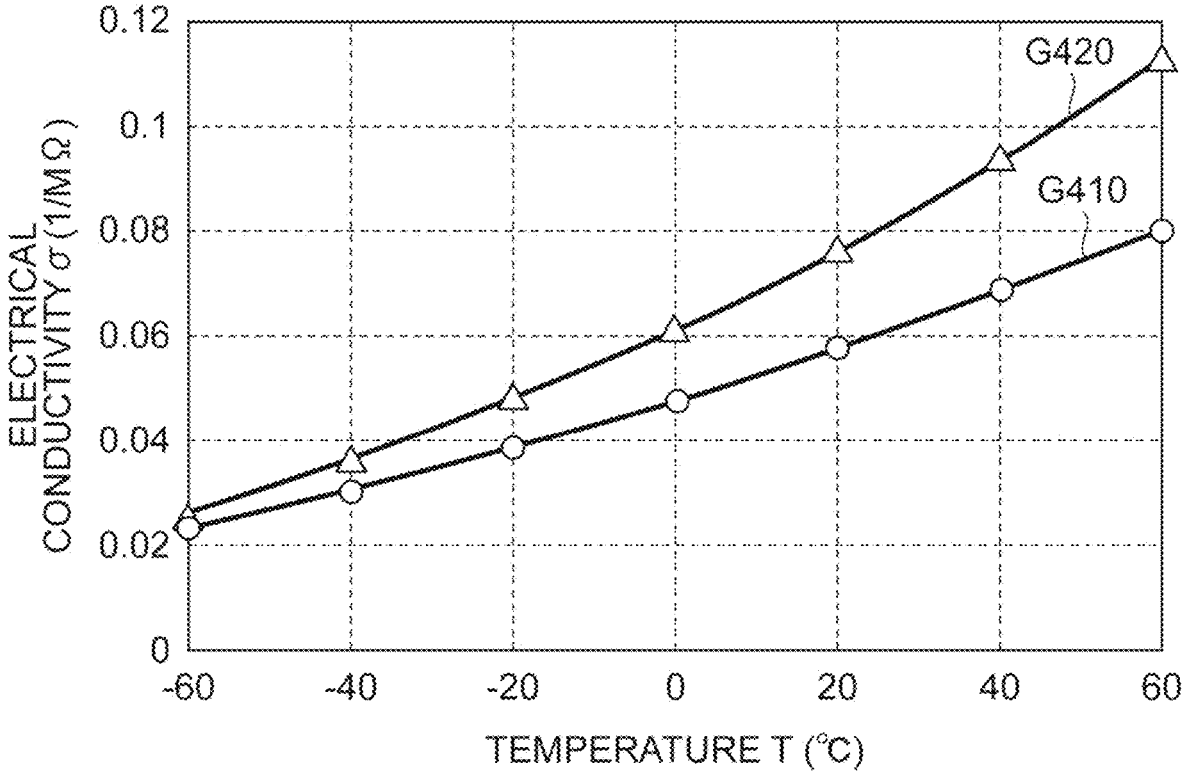
FIG. 5 is a graph illustrating temperature dependence of the electrical conductivity for each sample including a single Pt layer having a different thickness as the resistance layer.

Each Pt layer formed on the substrate 100 is filled with an insulating material (for example, MgO or $Al_2O_3$) between Pt particles having any energy level among a plurality of discrete energy levels, and free electrons in a certain Pt particle 121 (non-localized region) moves to the adjacent Pt particle 121 via the insulating material (localized region) by the tunnel effect (hopping). In such a two-dimensional electron conduction model, an electrical conductivity (reciprocal of resistivity) a with respect to a temperature T is given by the following formula. Incidentally, the following is limited to the two-dimensional electron conduction model in order to study the hopping inside the layer formation surface 140 in which the plurality of Pt particles 121 are two-dimensionally arranged on the layer formation surface 140.

$$\sigma = \sigma_0 \exp\left(-\left(\frac{T_0}{T}\right)^{\frac{1}{3}}\right)$$

$$T_0 = \frac{3}{k_B N(E_F) L_I^2}$$

σ: electrical conductivity
$\sigma_0$: electrical conductivity at T=∞
T: temperature (K)
$T_0$: temperature constant
$k_B$: Boltzmann coefficient
$N(E_F)$: state density
$L_I$: distance (m) between non-localized regions FIG. 5 is a graph in which actual measurement values of a plurality of samples actually measured are plotted together with fitting function graphs (G410 and G420) obtained based on the above formula. Incidentally, in FIG. 5, the graph G410 indicates the electrical conductivity σ of a sample in which a Pt layer whose thickness is adjusted to a thickness corresponding to 7 "cycles" by ALD is formed on the layer formation surface 140 of the underlying layer 130 comprised of $Al_2O_3$ and $Al_2O_3$ (the secondary electron emitting layer 110) adjusted to a thickness corresponding to 20 "cycles" is formed by ALD, and a symbol "○" is an actual measurement value thereof. Incidentally, the unit "cycle" is an "ALD cycle" that means the number of atom implantations by ALD. It is possible to control a thickness of an atomic layer to be formed by adjusting this "ALD cycle". In addition, the graph G420 indicates the electrical conductivity σ of a sample in which a Pt layer whose thickness is adjusted to a thickness corresponding to 6 "cycles" by ALD is formed on the layer formation surface 140 of the underlying layer 130 comprised of $Al_2O_3$ and $Al_2O_3$ (the secondary electron emitting layer 110) adjusted to a thickness corresponding to 20 "cycles" is formed by ALD, and a symbol "Δ" is an actual measurement value thereof. As can be understood from the graphs G410 and G420 in FIG. 5, it is possible to understand that the temperature characteristic is improved in teams of the resistance value of the resistance layer 120 when the thickness of the resistance layer 120 (specified by the average thickness of the Pt particles 121 along the stacking direction) is set to be thicker even if the Pt particles 121 constituting the resistance layer 120 are arranged in a plane.

Qualitatively, only the single Pt layer is formed between the channel formation surface 101 of the substrate 100 and the secondary electron emitting surface 111 in the case of the model of the electron multiplier according to the present embodiment illustrated in FIG. 4A. That is, in the present embodiment, the Pt particle 121 having such a crystallinity that enables confirmation of the peak at which the full width at half maximum has the angle of 5° or less is formed on the layer formation surface 140 at least in the (111) plane and the (200) plane in the spectrum obtained by XRD analysis. In this manner, a conductive region is limited within the layer formation surface 140, and the number of times of hopping of free electrons moving between the Pt particles 121 by the tunnel effect is small in the present embodiment.

On the other hand, in the case of the model of the electron multiplier according to the comparative example illustrated in FIG. 4B, the resistance layer 120 provided between the channel formation surface 101 and the secondary electron emitting surface 111 of the substrate 100 has the stacked structure in which the plurality of Pt layers 120B are arranged with the insulating layer interposed therebetween. In particular, it is difficult to confirm the crystallinity of each of the Pt particles 121 in such a structure in which the plurality of Pt layers 120B are stacked (it is difficult to confirm a plurality of peaks in a spectrum obtained by XRD analysis). In this manner, each Pt particle is small in the comparative example of FIG. 4B, and thus, the crystallinity is low, and the number of times of hopping increases. In addition, a conductive region expands not only in the layer formation surface 140 but also in the stacking direction, and thus, a negative temperature characteristic is exhibited more strongly in terms of a resistance value. On the other hand, in the present embodiment, the temperature characteristic relative to the resistance value is effectively improved due to the limitation of the conductive region and the decrease in the number of times of hopping of electrons between the Pt particles formed in a plane (metal particles constituting the single Pt layer).

Figure 6A:
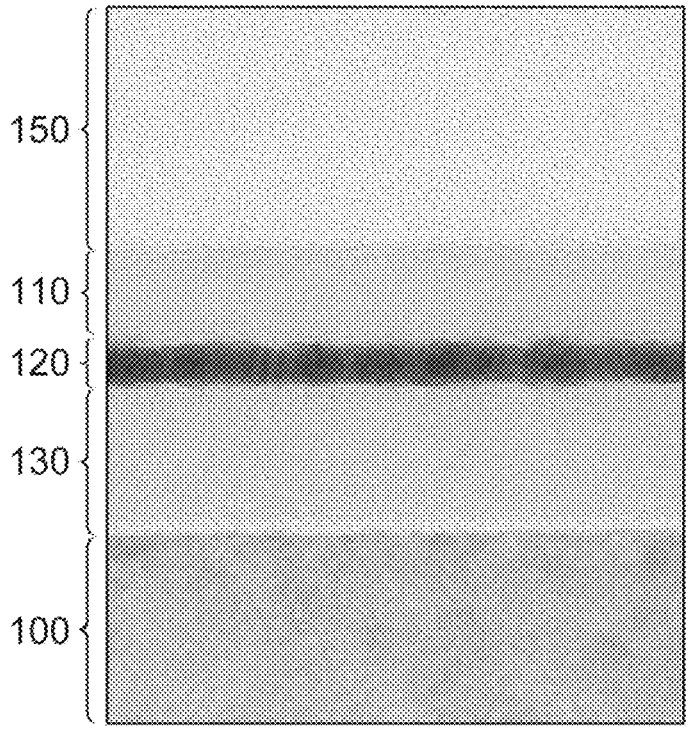
FIG. 6A is a transmission electron microscope (TEM) image of a cross section of the electron multiplier having the cross-sectional structure illustrated in FIG. 4A.
Figure 6B:
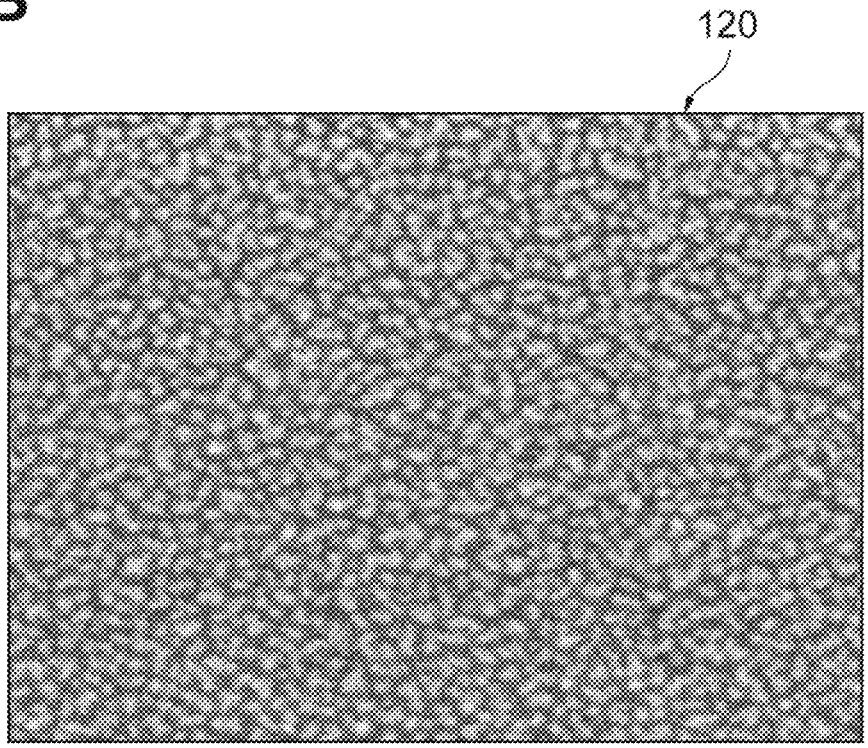
FIG. 6B is a scanning electron microscope (SEM) image of a surface of the single Pt layer (resistance layer).

FIG. 6A is a TEM image of a cross section of the electron multiplier according to the present embodiment having the cross-sectional structure (single-layer structure) illustrated in FIG. 4A, and FIG. 6B is an SEM image of a surface of the single Pt film (resistance layer 120). Incidentally, the TEM image in FIG. 6A is a multi-wave interference image of a sample having a thickness of 440 angstroms (=44 nm) obtained by setting an acceleration voltage to 300 kV. The sample of the electron multiplier according to the present embodiment from which the TEM image (FIG. 6A) was obtained has a stacked structure in which the underlying layer 130, the resistance layer 120 configured using the single Pt layer, and the secondary electron emitting layer 110 are provided in this order on the channel formation surface 101 of the substrate 100. Meanwhile, a sample from which the secondary electron emitting layer 110 was removed was used as a sample of the electron multiplier according to the present embodiment from which the SEM image (FIG. 6B) was obtained in order to observe the Pt film. A thickness of the single Pt layer (resistance layer 120) is adjusted to 14 [cycle] by ALD, and a thickness of the secondary electron emitting layer 110 comprised of $Al_2O_3$ is adjusted to 68 [cycle] by ALD. The single Pt layer (resistance layer 120) has a structure in which a portion between the Pt particles 121 is filled with an insulating material (a part of the secondary electron emitting layer). In addition, a layer 150 illustrated in the TEM image illustrated in FIG. 6A is a surface protective layer provided on the secondary electron emitting surface 111 for TEM measurement.

Figure 7A:
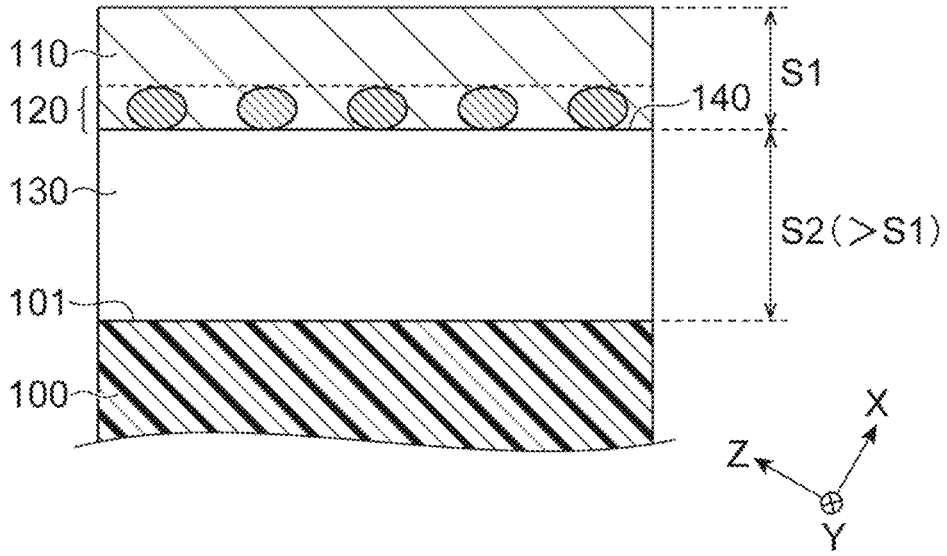
FIGS. 7A and 7B are views illustrating examples of various cross-sectional structures applicable to the electron multiplier according to the present embodiment.
Figure 7B:
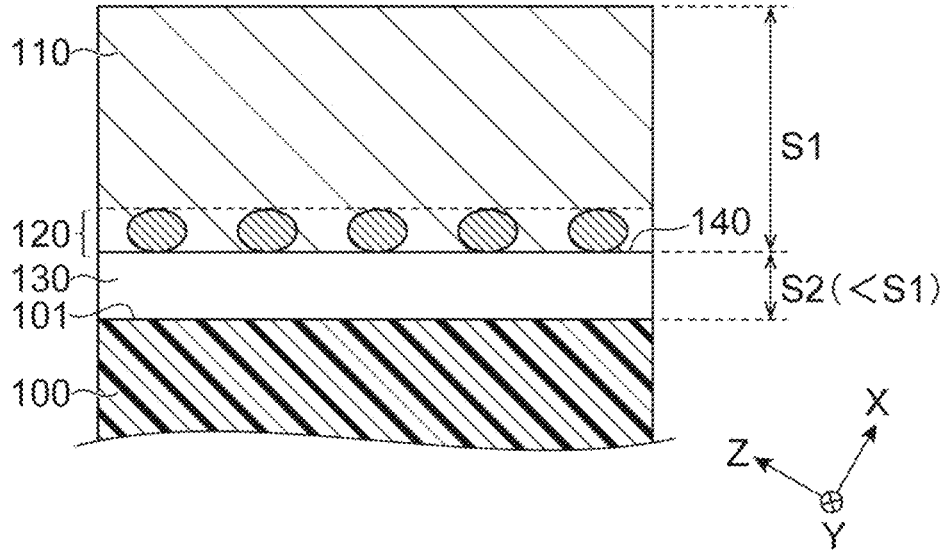

Incidentally, the first insulating material constituting the secondary electron emitting layer 110 described above and the second insulating material constituting the underlying layer 130 may be different from each other or the same. Further, a position of the resistance layer provided on the channel formation surface 101 of the substrate 100 can be arbitrarily set. For example, in the example illustrated in FIG. 7A, a thickness S1 of the secondary electron emitting layer 110 sandwiching the resistance layer 120 together with the underlying layer 130 is larger than a thickness S2 of the underlying layer 130. In this case, the resistance layer 120 is formed at a position closer to the secondary electron emitting surface 111 than the channel formation surface 101. When a material whose film formation stability by ALD is low is used as the resistance layer 120, it is possible to improve the film formation stability of the resistance layer 120 by forming the underlying layer 130 to be thick. Conversely, in the example illustrated in FIG. 7B, the thickness S1 of the secondary electron emitting layer 110 sandwiching the resistance layer 120 together with the underlying layer 130 is smaller than the thickness S2 of the underlying layer 130. In this case, the resistance layer 120 is formed at a position closer to the channel formation surface 101 than the secondary electron emitting surface 111. It is possible to improve the gain of the electron multiplier by forming the secondary electron emitting layer 110 to be thick.

Figure 8A:
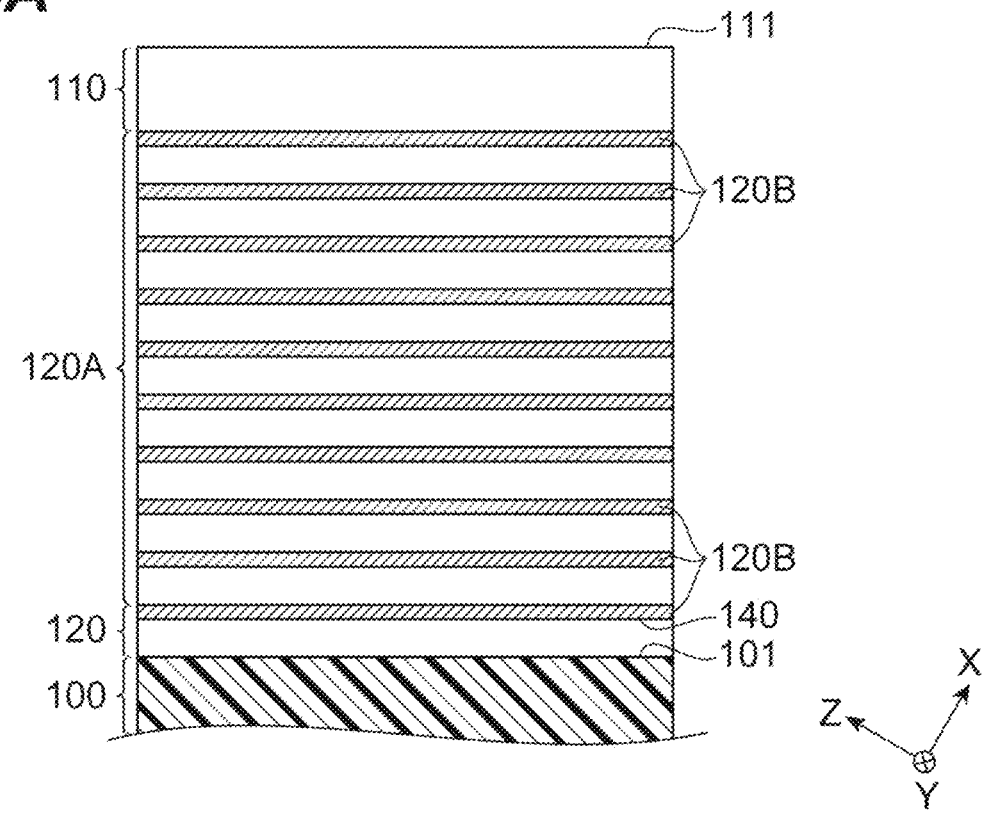
FIGS. 8A and 8B are views illustrating an example of a cross-sectional structure of the electron multiplier according to the comparative example (corresponding to the cross section of FIG. 4A) and a TEM image thereof.
Figure 8B:
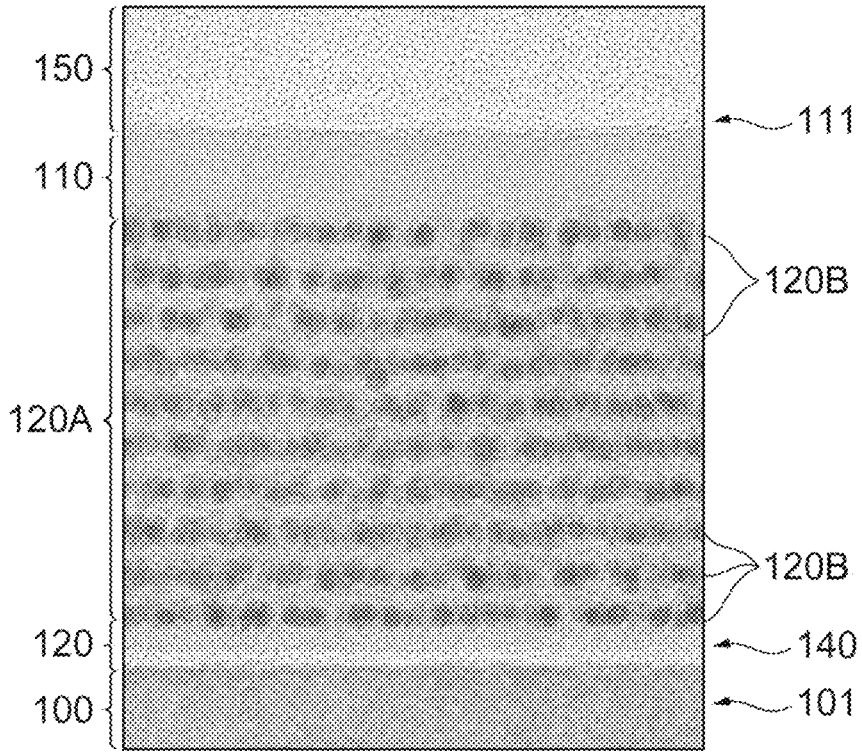

Meanwhile, FIG. 8A is a view illustrating an example of a cross-sectional structure of the electron multiplier according to the comparative example (corresponding to the cross section of FIG. 4B), and FIG. 8B is a TEM image thereof. The cross-sectional structure of the electron multiplier according to the comparative example is constituted by: the substrate 100; the underlying layer 130 provided on the channel formation surface 101 of the substrate 100; the resistance layer 120A provided on the layer formation surface 140 of the underlying layer 130; and the secondary electron emitting layer 110 that has the secondary electron emitting surface 111 and is arranged so as to sandwich the resistance layer 120A together with the underlying layer 130 as illustrated in FIG. 8A. In addition, the resistance layer 120A has a multilayer structure in which the plurality of Pt layers 120B are stacked from the channel formation surface 101 toward the secondary electron emitting surface 111 with the insulator layer interposed therebetween in the model of the comparative example (FIG. 8A). Incidentally, each of the Pt layers 120B has a structure in which a portion between the Pt particles 121 is filled with an insulating material (a part of the secondary electron emitting layer).

The TEM image in FIG. 8B is a multi-wave interference image of a sample having a thickness of 440 angstroms (=44 nm) obtained by setting an acceleration voltage to 300 kV, and the resistance layer 120A is constituted by ten Pt layers 120E with insulating materials comprised of $Al_2O_3$ interposed therebetween. A thickness of each insulating layer located between the Pt layers 120B is adjusted to 20 [cycle] by ALD, a thickness of each of the Pt layers 120B is adjusted to 5 [cycle] by ALD, and a thickness of the secondary electron emitting layer 110 comprised of $Al_2O_3$ is adjusted to 68 [cycle] by ALD. Incidentally, the layer 150 illustrated in the TEM image illustrated in FIG. 8B is a surface protective layer provided on the secondary electron emitting surface 111 of the secondary electron emitting layer 110.

Next, a description will be given regarding comparison results between an MCP sample to which the electron multiplier according to the present embodiment is applied and an MCP sample to which the electron multiplier according to the comparative example is applied with reference to FIGS. 9, 10A and 10B.

The sample of the present embodiment is a sample whose thickness is 220 angstroms (=22 nm) and which has the cross-sectional structure illustrated in FIG. 4A. The sample has a stacked structure in which the underlying layer 130, the resistance layer 120 configured using the single Pt layer, and the secondary electron emitting layer 110 are provided in this order on the channel formation surface 101 of the substrate 100. The single Pt layer (resistance layer 120) has a structure in which a portion between the Pt particles 121 is filled with an insulating material (a part of the secondary electron emitting layer), and a thickness thereof is adjusted to 14 [cycle] by ALD. A thickness of the secondary electron emitting layer 110 comprised of $Al_2O_3$ is adjusted to 68 [cycle] by ALD.

Meanwhile, the sample of the comparative example is a sample whose thickness is 440 angstroms (=44 nm) and which has the cross-sectional structure illustrated in FIG. 4B. The sample has a stacked structure in which the underlying layer 130, the resistance layer 120A, and the secondary electron emitting surface 111 are provided in this order on the channel formation surface 101 of the substrate 100. The resistance layer 120A has a structure in which ten Pt layers 120B are stacked with insulators interposed therebetween. Incidentally, each of the Pt layers 120B has a structure in which a portion between the Pt particles 121 is filled with an insulating material (a part of the secondary electron emitting layer). In addition, a thickness of each insulating layer located between the Pt layers 120B is adjusted to 20 [cycle] by ALD, a thickness of each of the Pt layers 120B is adjusted to 5 [cycle] by ALD, and a thickness of the secondary electron emitting layer 110 comprised of $Al_2O_3$ is adjusted to 68 [cycle] by ALD.

Figure 9:
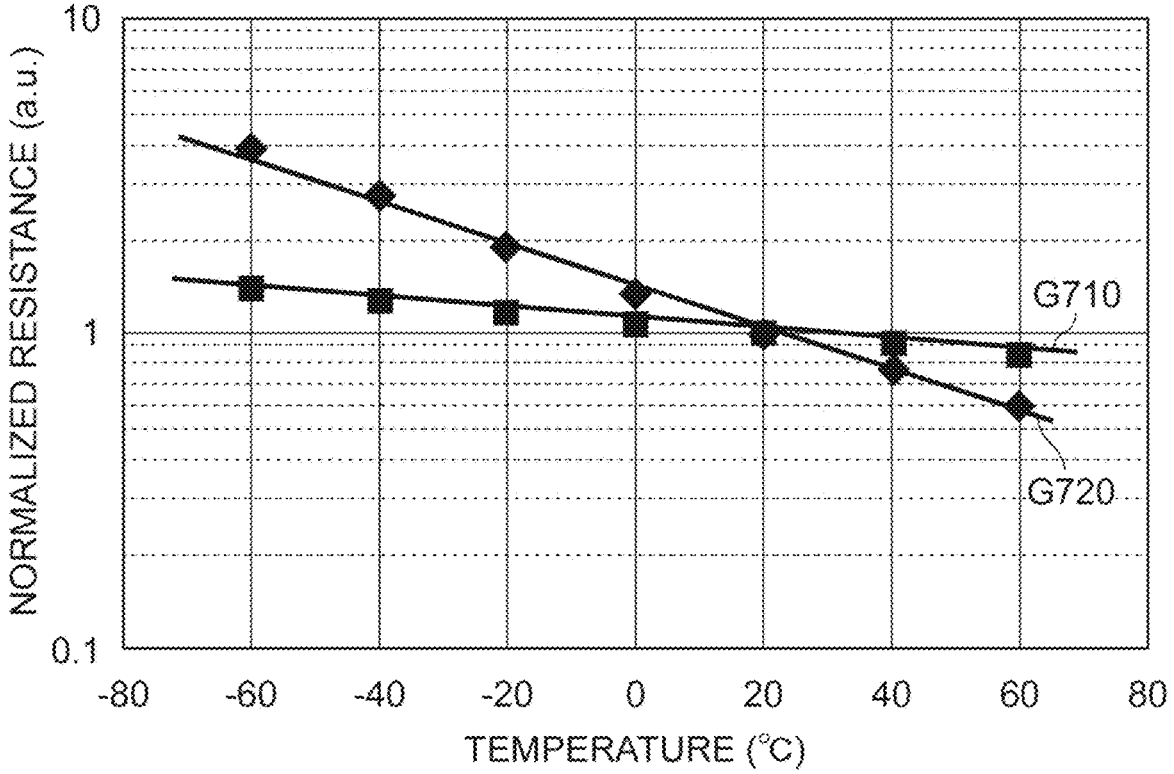
FIG. 9 is a graph illustrating temperature characteristic (in n operation with 800 V) of a normalization resistance in each of an MCP sample to which the electron multiplier according to the present embodiment is applied and an MCP sample to which the electron multiplier according to the comparative example is applied.
Figure 10A:
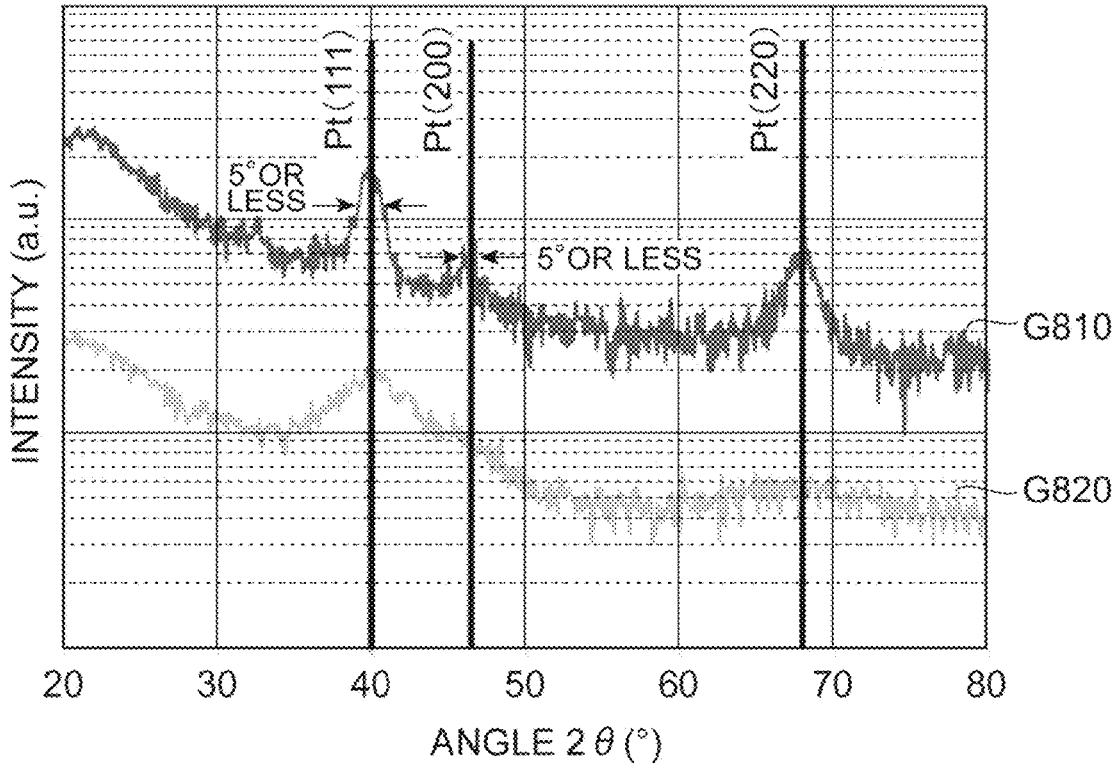
FIGS. 10A and 10B are spectra, obtained by x-ray diffraction (XRD) analysis, of each of a measurement sample corresponding to the electron multiplier according to the present embodiment, a measurement sample corresponding to the electron multiplier according to the comparative example, and the MCP sample applied to the electron multiplier according to the present embodiment.
Figure 10B:
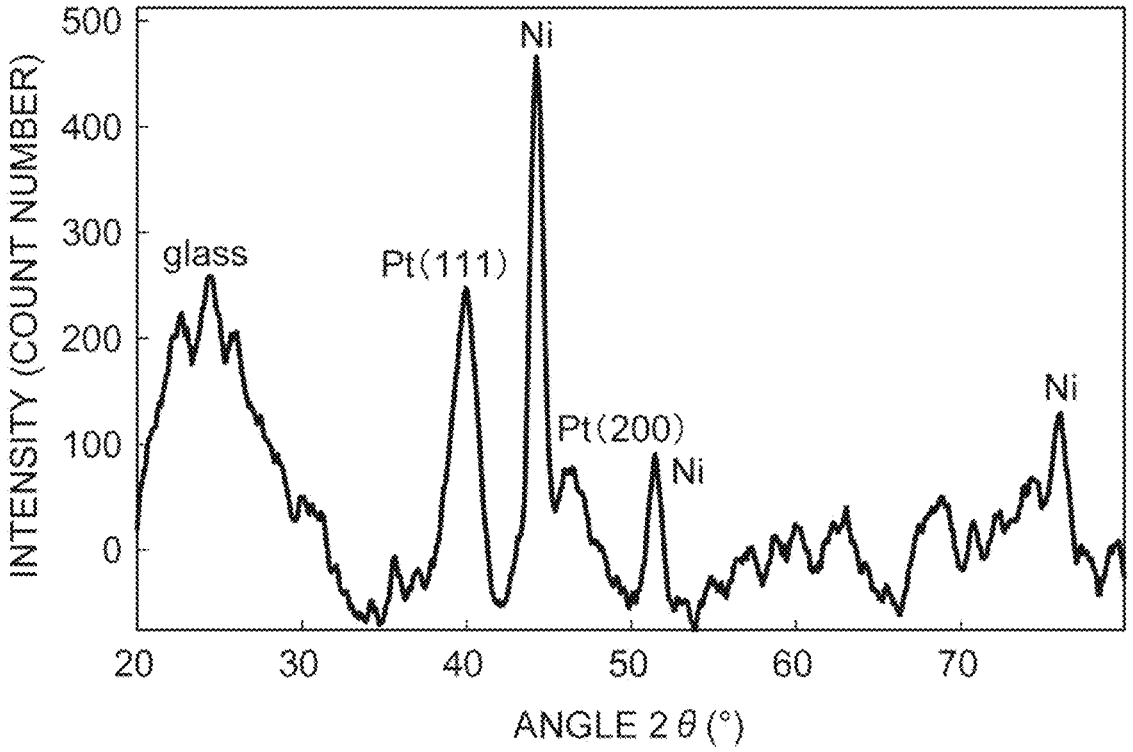

FIG. 9 is a graph illustrating temperature characteristic of a normalized resistance (at the time of an operation with 800 V) in each of the sample of the present embodiment and the sample of the comparative example having the above-described structures. Specifically, in FIG. 9, a graph G710 indicates the temperature dependence of the resistance value in the sample of the present embodiment, and a graph G720 indicates the temperature dependence of the resistance value in the sample of the comparative example. As can be understood from FIG. 9, a slope of the graph G710 is smaller than a slope of the graph G720. That is, the temperature dependence of the resistance value is improved by framing the resistance layer 120 in a state where the single Pt layer is limited two-dimensionally on the layer formation surface. In this manner, according to the present embodiment, the temperature characteristic is stabilized in a wider temperature range than the comparative example. Specifically, when considering an application of the electron multiplier according to the present embodiment to a technical field such as an image intensifier, it is preferable that the allowable temperature dependence, for example, falls within a range in which a resistance value at −60° C. is 2.7 times or less and a resistance value at +60° C. is 0.3 times or more with a resistance value at a temperature of 20° C. as a reference.

FIG. 10A illustrates a spectrum obtained by XRD analysis of each of a sample in which a film equivalent to the film formation for MCP (the model of FIG. 4A using the Pt layer) is formed on a glass substrate as a measurement sample corresponding to the electron multiplier according to the present embodiment and a sample in which a film equivalent to the film formation for MCP (the model of FIG. 4B using the Pt layer) is formed on a glass substrate as a measurement sample corresponding to the electron multiplier according to the comparative example. On the other hand, FIG. 10B is a spectrum obtained by XRD analysis of the MCP sample of the present embodiment having the above-described structure. In particular, a measurement mode of FIG. 10B is an MCP sample in which electrodes of a Ni—Cr alloy (Inconel: registered trademark) are provided as the input-side electrode 13A and the output-side electrode 13B. Specifically, in FIG. 10A, a spectrum G810 indicates an XRD spectrum of the measurement sample of the present embodiment, and a spectrum G820 indicates an XRD spectrum of the measurement sample of the comparative example. Meanwhile, an XRD spectrum of FIG. 10B was measured after removing the Ni—Cr alloy electrodes of the MCP sample of the present embodiment. Incidentally, as spectrum measurement conditions illustrated in FIGS. 10A and 10B, an X-ray source tube voltage was set to 45 kV, a tube current was set to 200 mA, an X-ray incident angle was set to 0.3°, an X-ray irradiation interval was set to 0.1°, X-ray scanning speed was set to 5°/min, and a length of an X-ray irradiation slit in the longitudinal direction was set to 5 mm.

In FIG. 10A, a peak at which a full width at half maximum has an angle of 5° or less appears in each of the (111) plane, the (200) plane, and the (220) plane in the spectrum G810 of the measurement sample of the present embodiment. On the other hand, a peak appears only in the (111) plane in the spectrum G820 of the measurement sample of the comparative example, but the full width at half maximum at this peak is much larger than the angle of 5° (a peak shape is dull). In this manner, the crystallinity of each Pt particle contained in the Pt layer constituting the resistance layer 120 is greatly improved in the present embodiment as compared to the comparative example.

It is obvious that the invention can be variously modified from the above description of the invention. It is difficult to regard that such modifications depart from a gist and a scope of the invention, and all the improvements obvious to those skilled in the art are included in the following claims.

REFERENCE SIGNS LIST

1 . . . micro-channel plate (MCP); 2 . . . channeltron; 12 . . . channel; 100 . . . substrate; 101 . . . channel formation surface; 110 . . . secondary electron emitting layer; 111 . . . secondary electron emitting surface; 120 . . . resistance layer; 121 . . . Pt particle (metal particle); 130 . . . underlying layer; and 140 . . . layer formation surface.

The invention claimed is:

1. An electron multiplier comprising:

a substrate having a channel formation surface;

a secondary electron emitting layer having a bottom surface facing the channel formation surface, and a secondary electron emitting surface which opposes the bottom surface and emits secondary electrons in response to incidence of a charged particle, the secondary electron emitting layer being comprised of a first insulating material; and a resistance layer sandwiched between the substrate and the secondary electron emitting layer, wherein the resistance layer includes a metal layer in which a plurality of metal particles are two-dimensionally arranged on a layer formation surface in a state of being adjacent to each other with a part of the first insulating material interposed between the metal particles, the metal particles each being comprised of a metal material whose resistance value has a positive temperature characteristic, the layer formation surface being coincident with or substantially parallel to the channel formation surface, and the metal layer existing between the channel formation surface and the secondary electron emitting surface, is constituted by only one layer.

2. The electron multiplier according to claim 1, further comprising an underlying layer provided between the substrate and the secondary electron emitting layer, the underlying layer having the layer formation surface at a position facing the bottom surface of the secondary electron emitting layer and being comprised of a second insulating material.

3. The electron multiplier according to claim 2, wherein the first insulating material and the second insulating material are different from each other.

4. The electron multiplier according to claim 2, wherein the second insulating material is an insulating material identical to the first insulating material.

5. The electron multiplier according to claim 2, wherein the first insulating material is MgO, and the second insulating material is $Al_2O_3$ or $SiO_2$.

6. The electron multiplier according to claim 2, wherein the secondary electron emitting layer is thicker than the underlying layer regarding a thickness of each layer defined along a stacking direction from the channel formation surface to the secondary electron emitting surface.

7. The electron multiplier according to claim 2, wherein the secondary electron emitting layer is thinner than the underlying layer regarding a thickness of each layer defined along a stacking direction from the channel formation surface to the secondary electron emitting surface.

8. The electron multiplier according to claim 1, wherein among the plurality of metal particles constituting the metal layer, at least one set of metal particles adjacent to each other with a part of the first insulating material interposed between the metal particles satisfies a relationship in which a minimum distance between the one set of metal particles is shorter than an average thickness of metal particles defined along the stacking direction from the channel formation surface toward the secondary electron emitting surface.

9. The electron multiplier according to claim 1, wherein the resistance layer has a temperature characteristic within a range in which a resistance value of the resistance layer at a temperature of −60° C. is 2.7 times or less, and a resistance value of the resistance layer at +60° C. is 0.3 times or more, relative to a resistance value of the resistance layer at a temperature of 20° C.

* * * * *